US011701285B2

(12) United States Patent
Hasnaoui

(10) Patent No.: US 11,701,285 B2
(45) Date of Patent: Jul. 18, 2023

(54) SUPPORT DEVICE FOR COFFIN AND FUNERARY MONUMENT AND ASSOCIATED COFFIN

(71) Applicant: Mansour Hasnaoui, Sin le Noble (FR)

(72) Inventor: Mansour Hasnaoui, Sin le Noble (FR)

( * ) Notice: Subject to any disclaimer, the term of this patent is extended or adjusted under 35 U.S.C. 154(b) by 229 days.

(21) Appl. No.: 17/290,700

(22) PCT Filed: Oct. 7, 2019

(86) PCT No.: PCT/IB2019/058521
§ 371 (c)(1),
(2) Date: Apr. 30, 2021

(87) PCT Pub. No.: WO2020/089712
PCT Pub. Date: May 7, 2020

(65) Prior Publication Data

US 2022/0015976 A1 Jan. 20, 2022

(30) Foreign Application Priority Data

Oct. 31, 2018 (FR) ..... 1871343

(51) Int. Cl.
*A61G 19/00* (2006.01)
*A61G 17/04* (2006.01)
*E04H 13/00* (2006.01)

(52) U.S. Cl.
CPC ..... *A61G 19/00* (2013.01); *A61G 17/047* (2016.11); *E04H 13/001* (2013.01); *E04H 13/003* (2013.01)

(58) Field of Classification Search
CPC .... A61G 19/00; A61G 17/047; A61G 17/001; E04H 13/00; E04H 13/001; E04H 13/003
USPC ..... 27/27, 32, 35; 52/128–130
See application file for complete search history.

(56) References Cited

U.S. PATENT DOCUMENTS 173,913 A * 2/1876 Decker ..... E04H 13/00 27/35
324,167 A * 8/1885 Robey ..... E04H 13/00 52/133
530,380 A * 12/1894 Barcus ..... E04H 13/00 52/136
720,163 A * 2/1903 Lockwood ..... E04H 13/00 27/35

(Continued)

FOREIGN PATENT DOCUMENTS

DE 8807375 U1 12/1988
WO 2013/051959 4/2013

OTHER PUBLICATIONS

Search Report and Written Opinion issued in Int'l Appl. No. PCT/IB2019/058521 (2019).

*Primary Examiner* — William L Miller
(74) *Attorney, Agent, or Firm* — Barnes & Thornburg LLP; G. Peter Nichols

(57) ABSTRACT

A support device for a coffin and funerary monument as well as a suitable coffin, in particular for burial in the ground, having a receiving platform suitable for supporting the base of the coffin, first pillars rigidly connected to the platform, means for receiving partitions between the first pillars, lateral partitions with an upper surface that constitutes a support surface, and at least one slab suitable for being positioned on the support surface to create a wall for protecting the coffin.

11 Claims, 2 Drawing Sheets

(56) References Cited

U.S. PATENT DOCUMENTS

| | | | | | |
|---|---|---|---|---|---|
| 1,082,803 | A | * | 12/1913 | Glotfelty | E04H 13/00 27/35 |
| 1,797,663 | A | * | 3/1931 | Lisle | A61G 19/00 27/26 |
| 1,830,629 | A | * | 11/1931 | Tulinski | E04H 13/003 27/1 |
| 1,886,437 | A | | 11/1932 | Wartman | |
| 2,249,687 | A | * | 7/1941 | Eshleman | A61G 19/00 27/26 |
| 2,658,253 | A | * | 11/1953 | Richardson | A61G 17/0076 220/651 |
| 2,781,571 | A | | 2/1957 | Clark | |
| 3,164,881 | A | * | 1/1965 | Mead | A61G 19/00 27/32 |
| 4,019,294 | A | * | 4/1977 | Bosico | E04H 13/003 52/103 |
| 6,243,997 | B1 | * | 6/2001 | Sannipoli | E04H 13/003 52/136 |
| 7,181,815 | B2 | * | 2/2007 | Hunter | E04H 13/001 27/30 |
| 2006/0123714 | A1 | * | 6/2006 | Sannipoli | E04H 13/003 52/103 |
| 2009/0260204 | A1 | | 10/2009 | Courchesne | |
| 2010/0242379 | A1 | * | 9/2010 | Norder | E04H 13/00 52/742.14 |
| 2012/0084953 | A1 | * | 4/2012 | Herridge | A61G 19/00 27/32 |
| 2016/0000632 | A1 | * | 1/2016 | Hoijng | A61G 17/004 27/2 |
| 2022/0015975 | A1 | * | 1/2022 | Hasnaoui | A61G 17/047 |

* cited by examiner

SUPPORT DEVICE FOR COFFIN AND FUNERARY MONUMENT AND ASSOCIATED COFFIN

This application is a U.S. nationalization under 35 U.S.C. § 371 of International Application No. PCT/IB2019/058521, filed Oct. 7, 2019, which claims priority to French Application No. 1871343, filed Oct. 31, 2018; the entire contents of each are incorporated herein by reference.

TECHNICAL FIELD

The invention is situated in the technical field of funeral parlors and more particularly that of techniques of burying a coffin in the ground and preservation of the latter.

That application is however not limiting on the invention and the support device could equally be used for the protection and the support of a coffin placed in burial plots with an entrance and a door below ground or partly below ground.

PRIOR ART

At present the works of preparing a burial plot for funeral rites are effected by a monumental mason using ancient techniques. Once the funeral rites have been completed, the monumental mason closes the burial plot by adding soil substantially to ground level. The monumental mason then waits for the backfilling earth to stabilize before installing the funerary monument and in particular the gravestone. This stabilization operation may be carried out by machines for compressing the soil or by allowing the soil to compact over a sufficient time period, generally three to six months.

A disadvantage of burial in the ground is that the coffin must be deposited at a great depth, variable in accordance with the laws and in particular in France of 1.5 m, which leads to backfilling with a large quantity of earth. The weight of this earth, in particular between 2 and 5 tons, exerts a very high pressure on the lid of the coffin. Upon closing the burial plot or within a relatively short time period from the funeral rites, it frequently happens that the lid is at least partly broken under the pressure and breaks the seal of the coffin.

In practice this destruction of the lid causes different problems and in particular the coming into contact with the outside of the body and of the fluids or gases of decomposition of the body leads to pollution of the environment, especially if the water table rises. Another disadvantage lies in the fact that, in the event of the seal being broken, earth comes to soil the body, which on the moral front is difficult to accept. Moreover, the at least partial destruction of the coffin considerably complicates operations of exhumation and/or of reduction, in particular for the collection of bones to be placed in the ossuary.

Another drawback of these burial techniques is the impossibility of placing the funerary monument on the burial plot rapidly because of the movements of the ground until the soil is stabilized, obliging the monumental mason to carry out on more than one occasion the operations on the one hand of burial and on the other hand of installing the funerary monument, including the laying of the base slab, of the sub-base, tumulary, base and stela.

SUMMARY OF THE INVENTION

The present invention relates to a support device for a coffin and funerary monument, in particular for burial in the ground, the device according to the invention including:

a receiving platform suitable for supporting the base of the coffin, first pillars rigidly connected to the platform, means for receiving partitions between said pillars, lateral partitions with an upper surface that constitutes a support surface, at least one slab to be positioned on the support surface to constitute a wall for protecting the coffin.

The present invention also aims to protect a coffin; in accordance with the invention coffin adapted to be received by a support device, said coffin including a lid and a base, the base including a lower part and an upper part, characterized in that the lower part rests on feet adapted to be engaged in recesses provided in the upper surface of the platform.

The present invention also aims to protect a funerary monument cooperating with said support device.

Resulting Advantages

A first object of the present invention is to solve some or all of the technical problems linked to the aforementioned prior art.

The present invention has for object alleviating the aforementioned disadvantages by proposing a coffin and funerary monument support device preventing destruction of the lid or of the coffin when buried.

The present invention also has for object proposing a coffin and funerary monument support device enabling rapid installation of the funerary monument with no delay for stabilization of the backfilling soil and with no operation of compacting said soil.

The present invention also has for object to propose a coffin and funerary monument support device allowing facilitated access to the coffin in the event of exhumation or reduction.

Another object of the present invention is to propose a coffin allowing good conservation of the body by evacuation and treatment of decomposition liquids and gases.

Another object of the present invention is to propose a funerary monument able to be supported by said support device of the invention.

BRIEF DESCRIPTION OF THE DRAWINGS

The present invention will be better understood on reading a detailed embodiment with reference to the appended figures, provided by way of nonlimiting example, in which.

DESCRIPTION OF THE EMBODIMENTS

Figure 1:
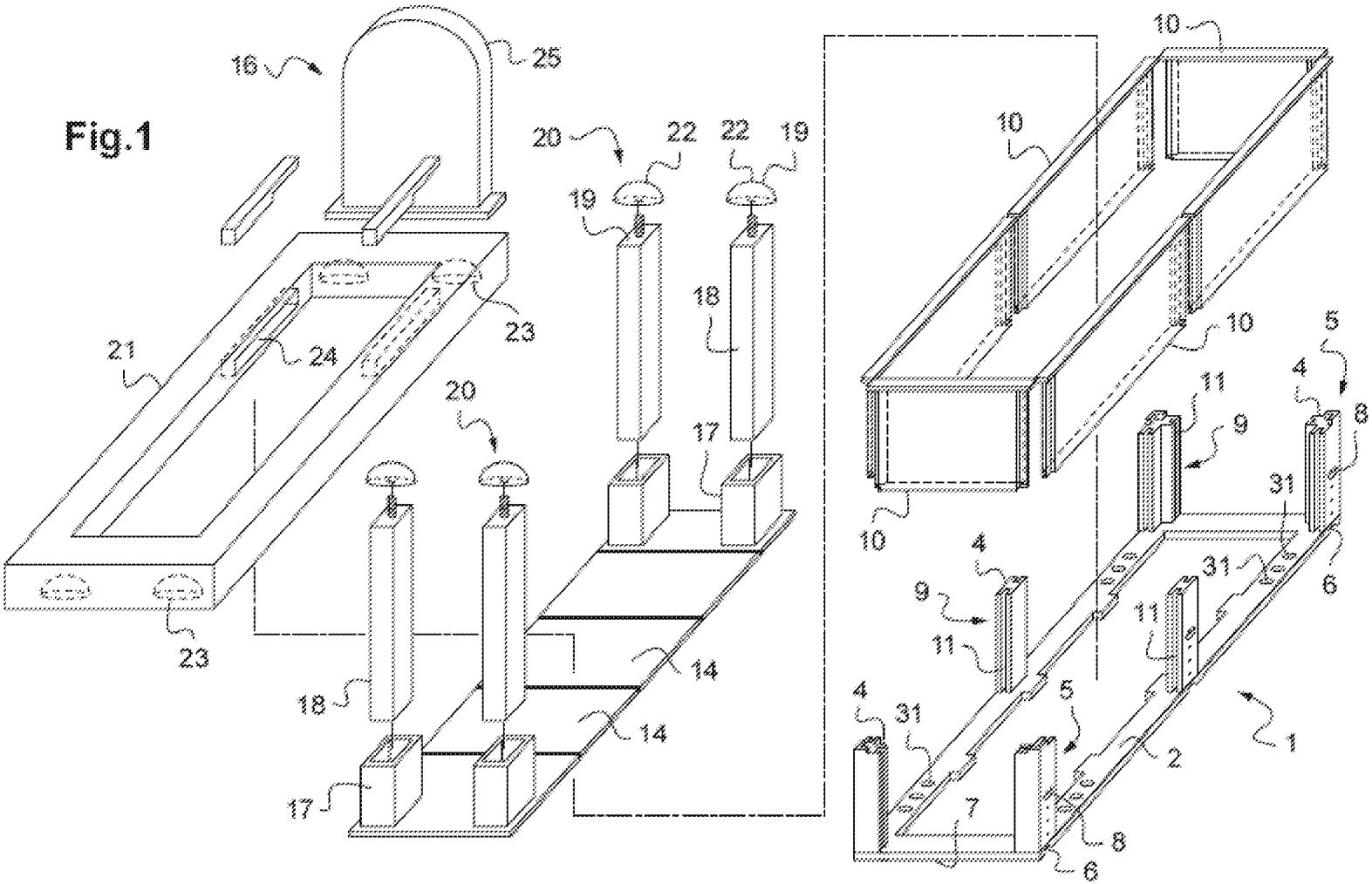
FIG. 1 represents in exploded perspective view one embodiment of a support device in accordance with the invention.
Figure 2:
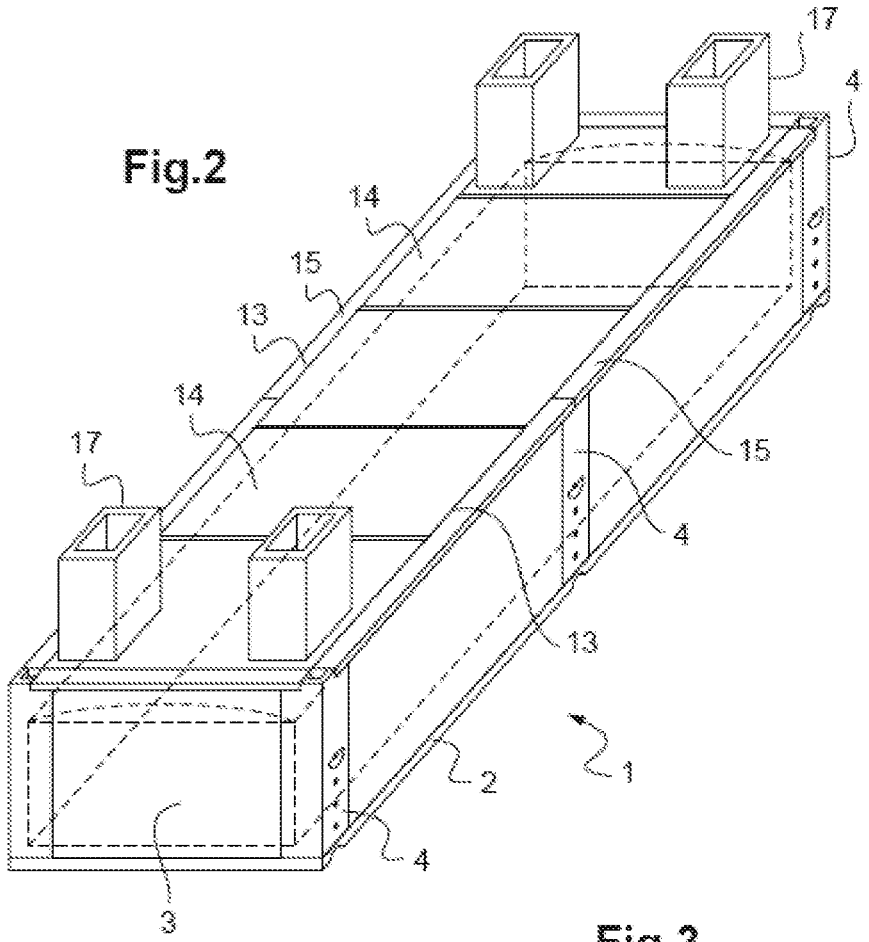
FIG. 2 represents in perspective view the support device from FIG. 1 incorporating a coffin.

The present invention aims to protect a coffin and funerary monument support device 1. Referring mainly to FIG. 1 it is seen that this support device 1 includes a receiving platform 2.

This platform 2 is able to support the base of the coffin 3, both when it is positioned in the bottom of the burial plot and during transport of the coffin 3 in the funerary vehicle or in the cemetery.

The support device 1 further includes first pillars 4 rigidly attached to the platform 2; these first pillars 4 are fixed at the level of their base to the platform 2 or possibly made in one piece with the platform 2.

It is advantageously the combination formed by the platform 2 with the first pillars 4 that will be moved with the coffin to avoid transporting in one block the entirety of the support device 1. In this manner it will be possible to move the coffin 3 and its platform 2 using standard handling machines or manually, the other elements of the support device 1 being fixed once the platform 2 is positioned in the burial plot.

Guide means 5 are provided for moving the platform 2 on which the coffin 3 rests. Those guide means 5 allow the platform 2 to be lowered by means of straps. To this end the guide means 5 include at least two grooves 6 on the lower surface 7 of the platform 2.

Each groove 6 allows the passage of a strap, whilst preventing the strap from moving out of the groove 6 during the manipulation of the platform 2. Once the platform 2 has been deposited, there is no tension in the straps and the straps are able to slide along each groove in order to be removed. In such a manner as to enhance the movement of the platform 2 by straps and in particular to prevent any tilting rings 8 are further provided at the level of the guide means 5. These rings 8 are disposed on the first pillars 4 facing the grooves 6 and allowing the passage of and the guidance of the straps.

The support device 1 also includes receiving means 9. These receiving means 9 allow positioning of partitions 10 between the first pillars 4.

As particularly represented in FIG. 1 the receiving means 9 advantageously include slides 11 integral with the first pillars 4. In another embodiment, however, these slides 11 may be rigidly attached to the first pillars 4. These slides 11 allow vertical sliding of the lateral partitions 10. Once the platform 2 is positioned at its final location to install the partitions 10 it suffices to cause them to slide to the bottom of the slides 11. When all of the lateral partitions 10 are in position the wall 12 protecting the coffin 3 can be positioned.

To this end the upper surface 13 of the lateral partitions 10 allows a support surface to be constituted. That support surface 13 allows positioning of at least one slab 14. In the embodiment from the appended figures five slabs are seen, these five slabs 14 constituting the wall 12 protecting the coffin. However, in other embodiments a greater number of slabs 14 could be provided, allowing the weight of each slab 14 to be reduced, or conversely only one large slab 14 used, in particular when the cemetery in which the burial plot is located possesses lifting tools accepting high loads.

To this end, to support the load of soil above the protection wall 12, the various constituent elements of the device 1, or at least those absorbing some of the forces exerted on the wall 12, are made from a concrete type material and in particular reinforced concrete or composite concrete.

To support the slabs 14, as well as constituting a support surface, the upper surface 13 of the lateral partitions 10 advantageously forms a corniche 15. This advantageous feature further allows immobilization of the slabs 14 as well as supporting them. The slabs 14 are in fact immobilized in translation against the edge of the corniche 15, which prevents all risk of the slabs 14 sliding, in particular during the operation of backfilling the burial plot.

If the platform 2 is installed with the coffin 3, after which the lateral partitions 10 are placed between the first pillars 4 and the slabs 14 are finally positioned, the support device 1 enables effective protection of the coffin 3 from the risks of breaking.

The support device 1 further includes elements enabling a funerary monument 16 to be supported. The support device 1 more particularly includes means 17 for fixing second pillars 18 to the slabs 14 at the level of said at least one slab 14. These second pillars 18 will enable the funerary monument to be supported.

On this subject, it is important to note that in the present application by funerary monument is meant an element allowing the location of the burial plot to be identified; it could in particular be a gravestone or a simple stela.

The length of the second pillars 18 will be determined as a function of the depth of the burial plot so that the funerary monument 16 is substantially placed in the plane of the ground surrounding the burial plot.

The end 19 of the second pillars 18 advantageously includes means 20 for cooperation with the frame 21 supporting the funerary monument 16. These cooperation means 20 include a hemispherical part 22 at the level of the end 19 of the second pillars 18 cooperating with cavities 23 formed in the supporting frame 21. This assembly allows self-centering of the funerary monument 16 relative to the second pillars 18. It moreover allows positioning of the funerary monument without using tools, the latter being held in place by gravity once positioned.

As represented in FIG. 1 the frame 21 supporting the funerary monument advantageously includes a window 24 or opening for the passage and the retention of the base of a stela 25.

Figure 3:
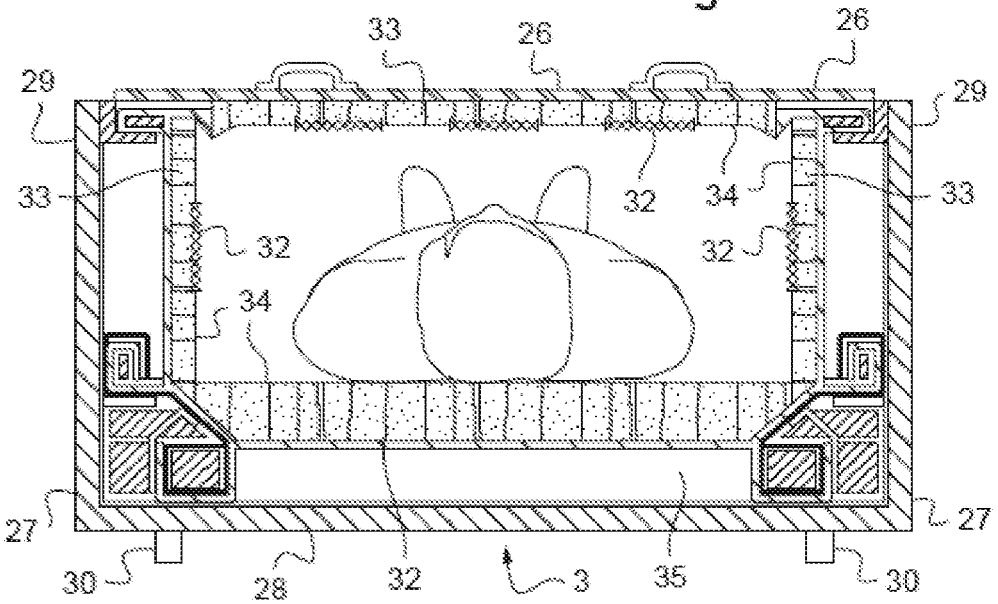
FIG. 3 represents a simplified schematic view of a coffin in accordance with the invention.

Referring more particularly to FIG. 3, it is seen that the coffin 3 includes a lid 26 and a base 27, the base including a lower part 28 and an upper part 29.

In accordance with the invention the lower part 28 rests on feet 30 adapted to be engaged in recesses 31 in the platform 2. The platform 2 advantageously includes a plurality of series of recesses allowing adaptation to a plurality of coffin sizes. The engagement between the feet 30 of the coffin and the recesses 31 allows slipping between the platform 2 and the coffin 3 to be prevented, in particular during lowering into the burial plot.

The coffin advantageously includes means 32 for filtering fluids and gases emitted by the decomposing body; to this end the filter means 32 includes at least one double wall 33 of which a geotextile internal wall 34 allows liquids and gases to pass through, said double wall 33 being filled with filter compounds, in particular based on activated charcoal.

A zone 35 for storing the filtered liquids is further provided under the double wall on which the body rests.

In accordance with one advantageous aspect the storage zone 35 is in contact with the lower part 28 of the base 27 of the coffin, that lower part 28 being made from a material that can be degraded by water so that the lower part 28 once degraded allows the evacuation of the filtered liquids.

Including means 32 for filtering bodily liquids associated with a zone 35 for storing the filtered liquids and a lower part 28 that may be degraded by the filtered liquids, the coffin 3 makes it possible to prevent stagnation in the coffin of liquids from the body. The filtered liquids are also evacuated below the platform 2 via its central opening.

Of course, other features of the invention could equally be envisaged without this departing from the scope of the invention defined by the following claims.

The invention claimed is:

1. A support device for a coffin and funerary monument for burial in the ground, comprising:

a receiving platform suitable for supporting a base of the coffin, first pillars rigidly connected to the platform, means for receiving lateral partitions between said first pillars, the lateral partitions having an upper surface that constitutes a support surface, and at least one slab to be positioned on the support surface to constitute a wall for protecting the coffin.

2. The support device according to claim 1 in which the upper surface of the lateral partitions forms a corniche for supporting and immobilizing the at least one slab.

3. The support device according to claim 1, in which the means for receiving includes slides integral with or rigidly attached to the first pillars allowing vertical sliding of the lateral partitions.

4. The support device according to claim 1, including guide means adapted to allow lowering of the receiving platform into a burial plot by means of straps.

5. The support device according to claim 4 in which the guide means include at least two grooves on a lower surface of the platform and rings on the first pillars disposed facing the grooves and allowing the passage of and the guiding of the straps.

6. The support device according to claim 1, including means for fixing second pillars at the level of said at least one slab and the second pillars for supporting the funerary monument.

7. The support device according to claim 6 in which an end of the second pillars includes means for cooperation with a support frame supporting the funerary monument.

8. The support device according to claim 7 in which the means for cooperation includes a hemispherical part at the level of the end of the second pillars cooperating with cavities formed in the support frame allowing self-centering of the funerary monument relative to the second pillars.

9. The funerary monument designed to be supported by the support device according to claim 6.

10. The coffin adapted to be received by the support device according to claim 1, including a lid and the base, the base including a lower part and an upper part, characterized in that the lower part rests on feet adapted to be engaged in recesses provided in an upper surface of the platform.

11. The coffin according to claim 10, including means for filtering bodily liquids associated with a zone for storing the filtered liquids such that the lower part can be degraded by the filtered liquids, allowing prevention of stagnation in the coffin of liquids from the body.

* * * * *